US005435162A

United States Patent [19]

Caudill et al.

[11] Patent Number: 5,435,162

[45] Date of Patent: Jul. 25, 1995

[54] ZONE HEATING APPARATUS

[75] Inventors: Maurice L. Caudill, Peoria, Ill.; Paul D. Andreson, South Bend, Ind.; Richard E. Couch, Niles, Mich.; Kevin M. Jacobs, Walkerton, Ind.; Richard R. Kazmierzak, South Bend, Ind.; Joel C. Schweisberger, Granger, Ind.

[73] Assignee: Caterpillar Inc., Peoria, Ill.

[21] Appl. No.: 102,670

[22] Filed: Aug. 5, 1993

[51] Int. Cl.[6] ..... B23P 25/00; F23D 23/00

[52] U.S. Cl. ..... 72/21; 72/202; 72/342.96; 432/225

[58] Field of Search ..... 72/199, 200, 202, 21, 72/13, 342.1, 342.94; 83/15, 16; 100/38, 92, 93 RP; 432/38, 42, 88, 162, 166, 225

[56] References Cited

U.S. PATENT DOCUMENTS

| | | | |
|---|---|---|---|
| 372,621 | 11/1887 | Hilton . | |
| 1,040,398 | 10/1912 | Parmelee . | |
| 1,891,338 | 12/1932 | Snell . | |
| 2,053,234 | 9/1936 | Anderson | 432/225 |
| 2,242,204 | 5/1941 | Kennedy | 72/202 |
| 2,424,643 | 7/1947 | Williams | 153/21 |
| 2,922,014 | 1/1960 | Green | 219/7.5 |
| 3,400,566 | 9/1968 | Gauer | 72/199 |
| 3,541,832 | 11/1970 | Loftus et al. | 72/364 |
| 3,568,490 | 3/1971 | Bohmann | 73/13 |
| 4,266,989 | 5/1981 | Ludwigson | 148/9 R |
| 4,444,558 | 4/1984 | Kinto | 432/225 |
| 5,024,074 | 6/1991 | Blunier et al. | 72/16 |
| 5,113,677 | 5/1992 | Blunier et al. | 72/7 |

FOREIGN PATENT DOCUMENTS

| | | | |
|---|---|---|---|
| 0165510 | 12/1981 | Japan | 72/202 |
| 61-235020 | 3/1987 | Japan . | |
| 63-049318 | 7/1988 | Japan . | |
| 0248709 | 11/1991 | Japan | 72/342.1 |

*Primary Examiner*—Lowell A. Larson
*Assistant Examiner*—Thomas C. Schoeffler
*Attorney, Agent, or Firm*—Alan J. Hickman

[57] ABSTRACT

A zone heating device has first and second spaced burners for heating first and second spaced sides of a metal plate during forming of a thickened edge along the edge of the metal plate. The first and second burners are elevationally movable by an actuator between first and second spaced transverse positions relative to the sides of the metal plate. An actuator moves the zone heating device along a trackway in directions transverse the plate edge. A fixed guide under the bias of the actuator engages the edge of the metal plate and maintains the first and second burners at a predetermined location relative to the plate edge. A movable guide maintains the first and second burners at another preselected location relative to the plate edge. A control device controls movement of the first and second burners, the zone heating device, and the movable guide in response to preprogrammed instructions. The zone heating device is particularly suited for use on a forming apparatus.

38 Claims, 13 Drawing Sheets

ZONE HEATING APPARATUS

TECHNICAL FIELD

This invention relates to a zone heating device and more particularly, to a zone heating apparatus having first and second heating devices positionable relative to a metal plate to heat a zone along the edge of a metal plate during upsetting of the plate edge.

BACKGROUND ART

Flame heating metal material to lower the yield strength so that the shape of the stock can be changed is well known in the art. Flame heating is commonly used in processes associated with the bending and forging of metal stock and in heat treating applications.

Forming of a thickened linear edge along an edge of a cold metal plate or sheet stock is a common practice. An example of this is shown in U.S. Pat. Nos. 1,040,398, to C. L. Parmelee, dated Oct. 8, 1912 and 3,400,566 to, W. Gauer, dated Sep. 10, 1968. Each patent discloses a plurality of rollers for forcibly engaging the cold metal stock and forming a thickened edge along the full length of the linear edge. Forming a thickened edge by displacing cold material places extremely high loads on the rollers which causes premature roller wear. This wear causes deviations in the shape of the formed edge and results in a high incidence of scrap of the resulting formed material. These excessively high loads are also transferred to other parts of the machine forming the stock causing premature wear and failure of these parts. In addition, special materials and heat treated materials cannot be cold rolled without cracking.

Several passes between the forming roller and stock is required to produce a thickened edge along the cold edge of the stock. Since the quality (surface finish, shape and accuracy) of the formed thickened edge is inversely proportional to the magnitude of force applied to the forming rollers it is advantageous to reduce the force and increase the number of passes. It has been found that high forces tend to cause the metal to push and tear in the direction of movement which results in a reduction in the quality of the final formed product. The large number of passes required to obtain a quality edge also increases the cost of manufacture and causes a reduction in the output.

Forming cold metal work hardens the material which may not be a desirable in metal plate having a formed edge. Mill scale (iron oxide) often found on the surface of metal plate flakes during cold forming which causes abrasion of the forming roller and causes premature roller wear. Heating of the metal plate causes the mill scale to pop off which reduces the mill scale abrasion problem. The ultimate tensile and yield strength of the plate edge being formed is reduced by heating and therefor the problems associated with cold forming are eliminated. It would be advantageous to provide an apparatus capable of controllably heating the metal plate during forming to eliminate these cold forming problems. However, the forming of irregular shaped edges, intermittent formed edges, or raised edges adds a dynamic dimension to the forming process not addressed by conventional devices.

Selective forming of a thickened edge along an edge of a metal plate is disclosed in U.S. Pat. Nos. 5,024,074, dated Jun. 18, 1992, and U.S. Pat. No. 5,113,677, dated May 19, 1992, both to D. L. Blunier et al. and assigned to the Assignee of the instant invention. Selective forming refers to the ability to upset either continuous or intermittent thickened edges on a plate having linear or irregular shaped edges. An apparatus capable of selective forming is subjected to variable forces, for example, caused by the forming of an intermittent thickened edge along a plate having a straight edge, and a thickened edge, intermittent or otherwise, along a plate edge having an irregular shape. These variable forces increase in magnitude in response to, for example, an increase in plate thickness, material hardness, feed speed of the plate relative to the forming apparatus and the like. As indicated above it is advantageous to reduce the force—speed ratio in some manner so as to maximize productivity, improve quality, and reduce cost.

U.S. Pat. No. 1,891.338, to Lester W. Snell, dated Dec. 20, 1932 discloses a fixed flame burner disposed adjacent a tube bending die for the purpose of heating the tube during bending. This heating of the tube is localized and causes upsetting of the tube during bending so that the crossectional thickness of the tube is controlled from thinning at the bend. This fixed burner is suitable for use in the bending of a single tube size but it is not appropriate for use in bending tubes of other diameters and thickness since the heating locations are fixed and do not provide an ability to adjust for varying tube sizes, shapes, and thickness.

Because metal plates requiring edge forming vary in thickness, configuration, edge profile, shape, material and the like, a fixed flame heating device such as disclosed in this patent is not suitable for plate edge forming. Further, in order to accommodate these differences it is necessary to provide an apparatus with variable heat and plate edge following capabilities.

The present invention is directed to overcoming one or more of the problems as set forth above.

DISCLOSURE OF THE INVENTION

In one aspect of the present invention, a zone heating device for heating a predetermined area of a metal plate relative to an edge of the metal plate during upsetting of the edge is provided. The zone heating device has a supporting frame with a pivot axis oriented transverse first and second plate sides. The supporting frame is pivotally movable about the pivot axis. A first burner connected to the supporting frame is movable between first and second predetermined transversely spaced heating positions relative to the first side of the plate. A second burner movably connected to the supporting frame is movable between first and second predetermined transversely spaced heating positions relative to the plate second side. The plate is located between the first and second burners. An actuating means moves the first burner between first and second predetermined spaced heating positions relative to the first side of the plate and the second burner between first and second predetermined spaced heating positions relative to the second side of said plate.

In another aspect of the invention, an apparatus for selectively forming a thickened edge along an edge of a metal plate having first and second sides is provided. A forming roller has an axis of rotation oriented transversely relative to the first and second plate sides. A power means reciprocally moves one of the metal plate and the forming roller transversely of the forming roller axis. The forming roller upsets at least a portion of the edge along the metal plate into a thickened edge during the relative movement. The apparatus includes a first zone heating device and a second zone heating device. The first zone heating device has a supporting frame and a first burner movably connected to the supporting frame. The first burner is movable relative to the first supporting frame between a first position at which the first burner is spaced a preselected first transverse distance from the first side of the metal plate and a second position at which the first burner is spaced a second different preselected transverse distance from the first side of the metal plate. The second zone heating device has a supporting frame and a first burner. The first burner of the second zone heating device is movable relative to the supporting frame of the second zone heating device between a first position at which the first burner of the second zone heating device is spaced a first preselected transverse distance from the first side of the metal plate and a second position at which the first burner of the second zone heating device is spaced a second different preselected transverse distance from the first side of the metal plate. A first actuator moves the first burner of each of the first and second heating devices between the first and second spaced positions. A drive means moves the first and second heating devices transversely relative to the plate edge. A fixed guide means engages the edge of said metal plate and maintains the first burner of the first and second zone heating devices at a predetermined first transverse distance spaced from the edge of the metal plate. The fixed guide means is connected to the supporting frame of the first and second zone heating devices. The first and second zone heating devices and forming roller are spaced from each other, and the forming roller is located between the first and second heating devices.

In yet another aspect of the present invention, an apparatus for heating a zone of a metal plate during forming of a thickened edge along an edge of the metal plate is provided. The apparatus includes first and second spaced zone heating devices each having first and second spaced movable burners. The first burners are located on a first side of the plate and the second burners are located on a second side of the plate. The first burners are movable transversely relative to the plate first side between first and second predetermined spaced heating positions. A fixed guide means maintains the first and second burners of the first and second heating devices at a first predetermined transverse location relative to the plate edge. The fixed guide means is connected to the first and second heating devices and is engagable with the plate edge at the first transverse position relative to the plate edge. The guide means is connected to the first and second heating devices. An actuating means moves the first and second burners between the first and second spaced positions relative to the plate sides. A drive means moves the first and second heating devices transversely relative to the plate edge. A means senses the fixed guide means at the first position and responsively delivers a guide position signal. A control means receives the guide position signal and delivers a control signal in response to receiving the guide position signal. The drive means receives the control signal and stops transverse movement of at least one of the first and second heating devices relative to the plate edge in response to receiving the control signal.

BEST MODE FOR CARRYING OUT THE INVENTION

Figure 1:
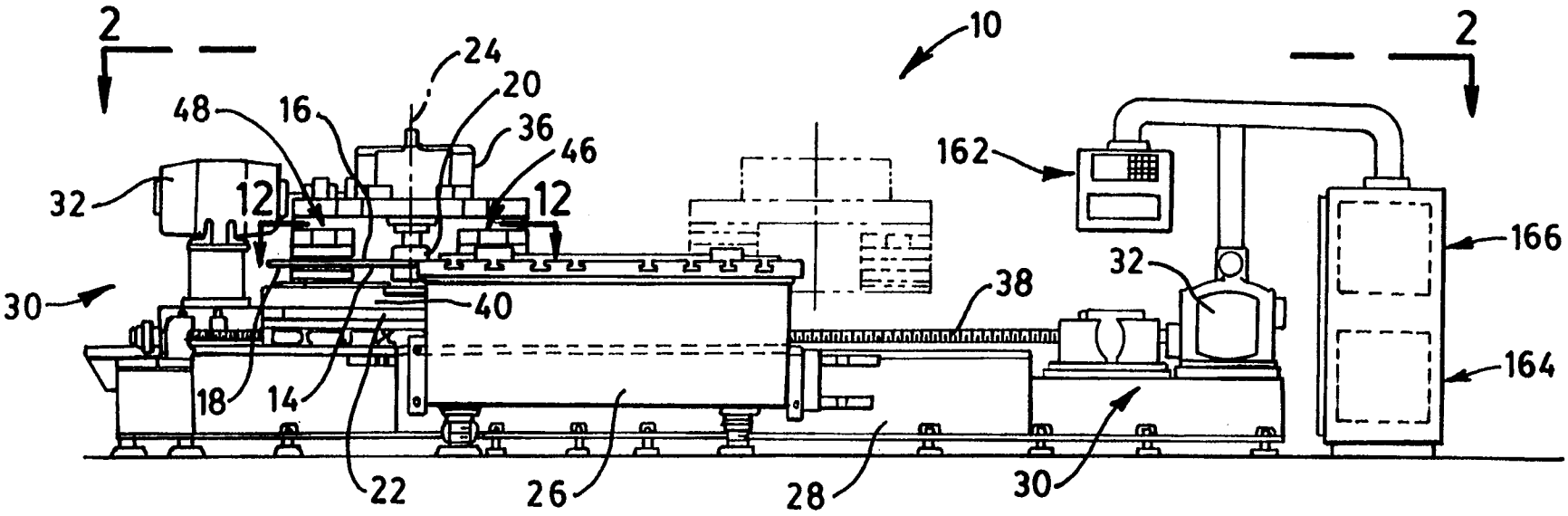
FIG. 1 is a diagrammatic elevational view of an embodiment of the present invention showing a selective forming device and first and second spaced zone heating devices.
Figure 2:
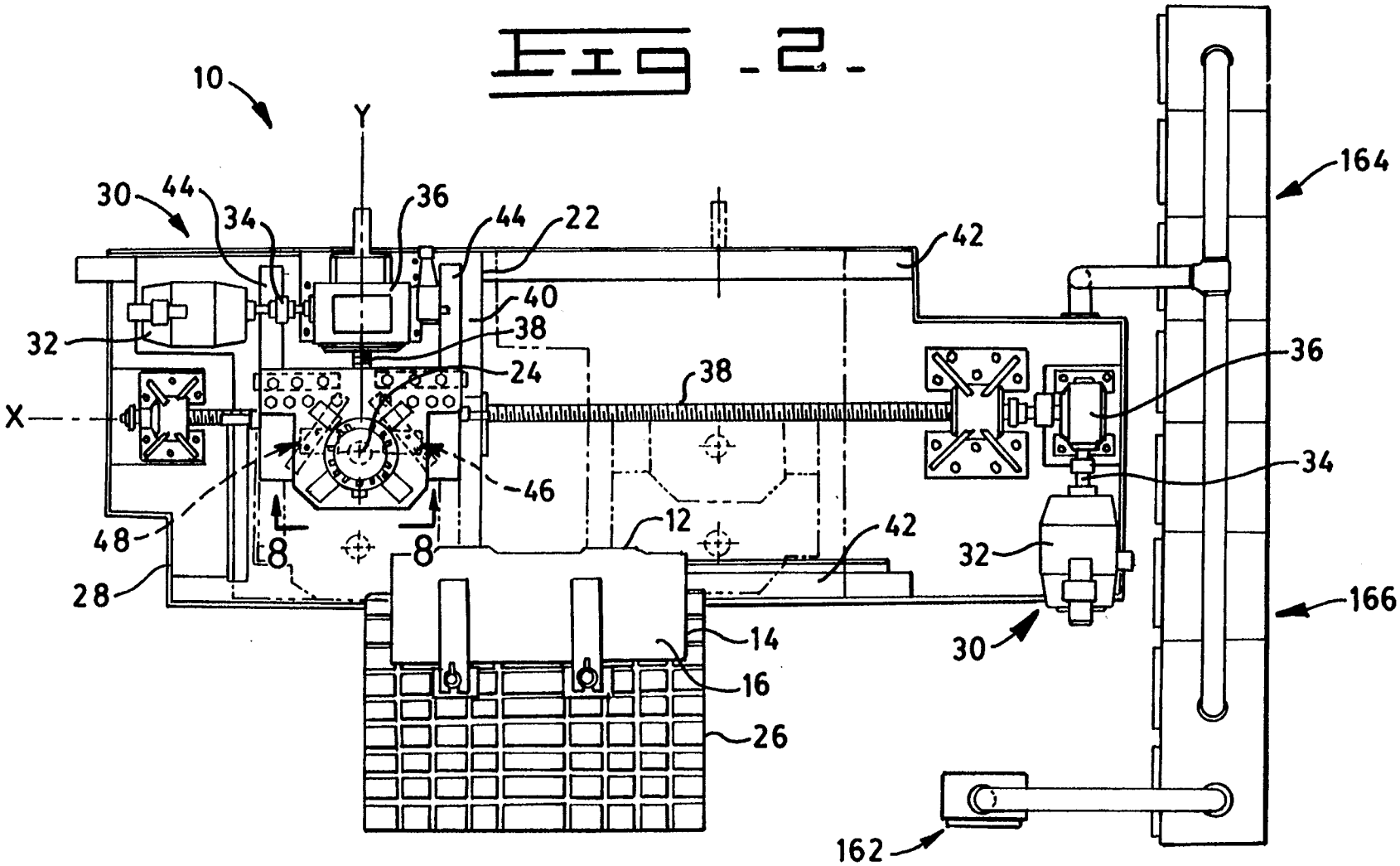
FIG. 2 is a diagrammatic top plan view taken along lines 2—2 of FIG. 1 showing the selective forming and first and second heating devices in greater detail.

With reference to the drawings, and particularly FIGS. 1 and 2, an apparatus 10 for forming a thickened edge along an edge 12 of a metal plate 14 having first and second sides 16,18 (FIG. 8) is shown. The forming apparatus 10 has a cylindrical forming roller 20 rotatably connected to a carriage 22 of the forming apparatus 10. The forming roller 20 has a longitudinal axis 24 which is oriented transversely relative to the first and second plate sides 16,18. The forming apparatus 10 has a table 26 and a bed 28. The plate 14 is securely clamped to the table 26 and the carriage 22 is movably mounted on the table 26 and guided for movement relative to the bed 28. A power means 30 is provided for reciprocally moving the carriage 22 along the bed 28 and relative to the edge 12 of the metal plate 14 being formed. Since the forming roller is attached to the carriage 22, reciprocal movement of the carriage results in reciprocal movement of the forming roller in directions transverse the forming roller axis 24 and along the edge 12. The power means 30 also moves the forming roller in a direction transverse the roller axis 24 and in directions transverse the edge 12. Thus movement of the forming roller in both the X and Y directions as viewed in the plan view of FIG. 2 relative to the edge of the metal plate 14 is provided.

The power means 30 includes a pair of drive motors 32 one of which is connected to the bed 28 and the other to the carriage 22. The drive motors 32 are either electrically or fluid operated motors having a rotatable output shaft 34. Each of the rotatable output shafts 34 is coupled to a transmission 36. The transmissions 36 are each connected to a feed screw 38. One of the feed screws 38 is screwthreadably connected to the carriage 22 and the other feed screw 38 is rotatably connected to a support housing 40 movably mounted on the carriage 22. The forming roller 20 is rotatably mounted on the support housing and movable transversely relative to the plate edge 12 in response to movement of the support housing 40 on the carriage 22. The support housing 40 and the forming roller 20 are movable together in directions transverse the plate edge 12.in response to rotation of the feed screw 38 connected thereto. The carriage 22 is movable along the bed 28 in response to rotation of the feed screw 38. The feed screws 38 rotate in response to rotation of the output shaft 34 of the respective motors 32. Thus, the power means 30 effectively causes movement of the forming roller 20 in the X and Y directions as viewed in FIG. 2. The power means 30 is effective to force the forming roller into the metal plate 14 and form a thickened edge along at least a portion of the edge of the metal plate 14. Alternatively, a drive means of equivalent construction to the power means 30 connected to the table 26 could be provided to move the table 26 in the X and Y directions relative to the forming roller 20 and provide an equivalent function as previously described.

A first pair of spaced parallel guides 42 is provided for guiding the carriage 22 transverse the forming roller axis 20 and along the bed 28. The guides 42 extend in directions substantially parallel to the feed screw 38 and provide for translation of the forming roller 20 along the X coordinate axis. A second pair of parallel spaced guides 44 direct motion of the support housing 40 in directions transverse the roller axis 24 and along the Y coordinate axis. The second pair of guides 44 are substantially normal to the first pair of guides. The feed screw 38 connected to the support housing 40 causes translation of the support housing 40 in response to feed screw rotation. The carriage connected feed screw 38 provides for translation of the carriage 22 in response to rotation thereof. The direction of rotation of the feed screws 38 determines the direction of translation along the guides 42,44.

Figure 12:
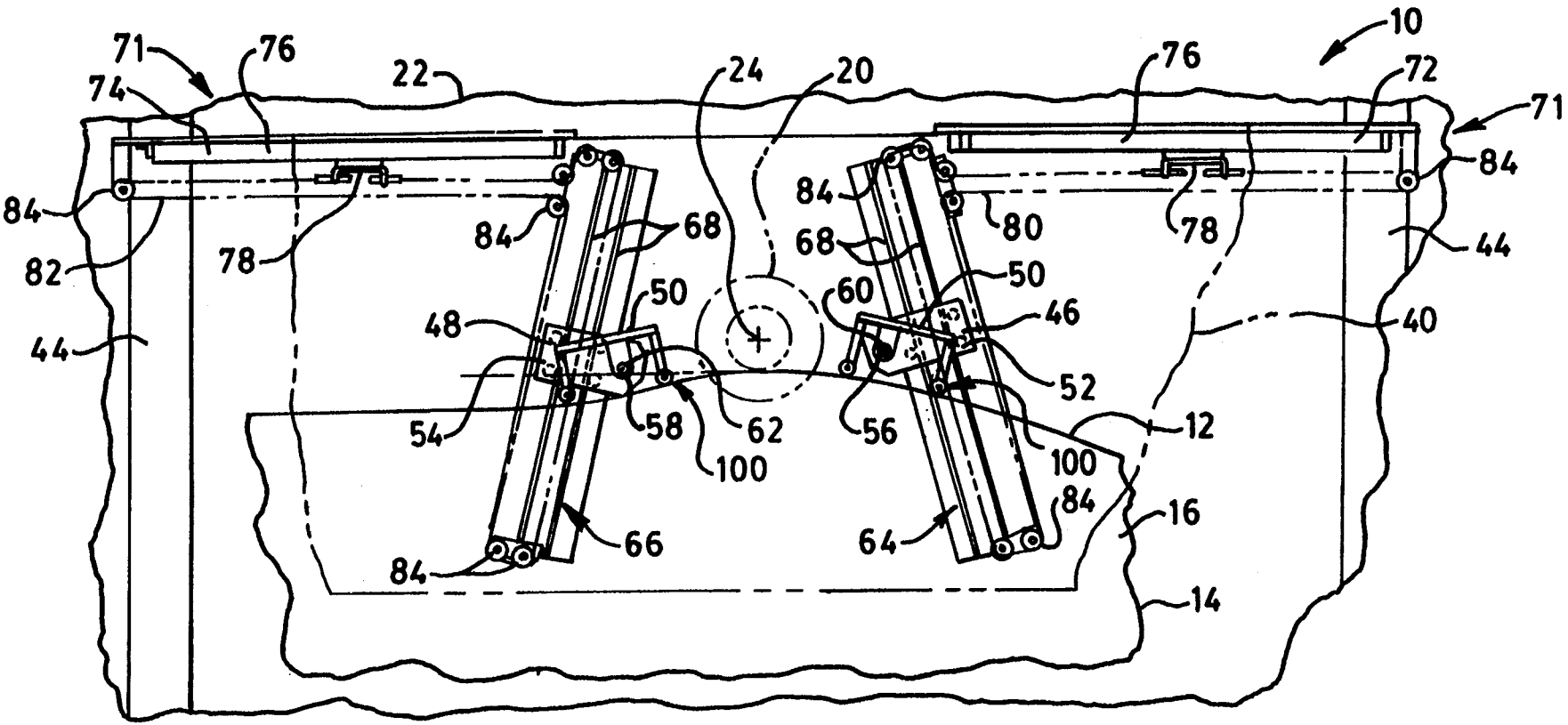
FIG. 12 is a diagrammatic partial top plan view taken along lines 12—12 of FIG. 1 showing the power means for moving the first and second heating devices in transverse directions relative to the edge of the plate being upset.

Referring to FIGS. 1 and 2 first and second spaced apart zone heating devices 46,48 are movably connected to the carriage 22 and particularly the support housing 40 carried on the carriage 22. The first and second zone heating devices 46,48 are spaced from each other and the longitudinal roller axis 24. As shown in FIGS. 2 and 12 the spaced apart position of the heating devices 46,48 is determined by the location of the edge 12 of the metal plate 14 on the table 26, and the relative location of the forming roller 20.

Figure 6:
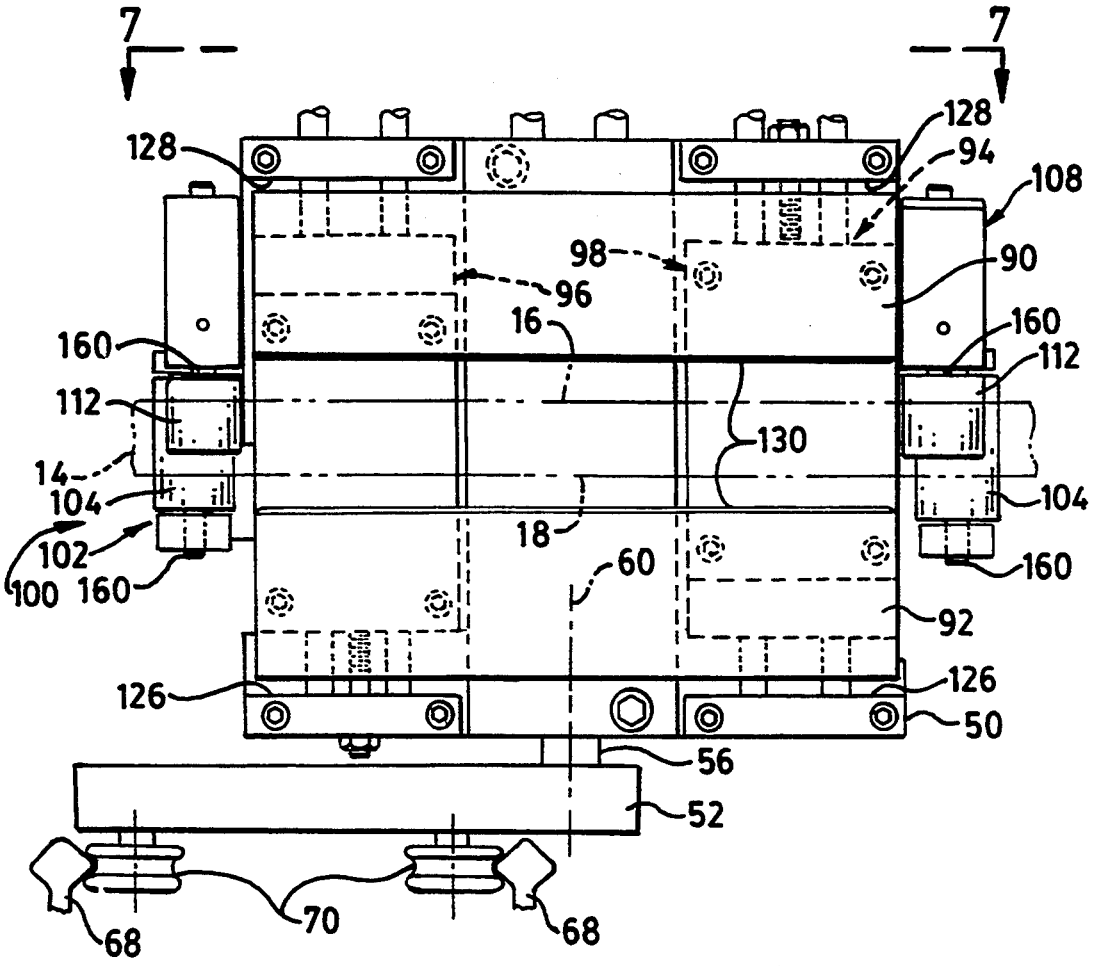
FIG. 6 is a diagrammatic front elevational view of the heating device of FIG. 3.

As best seen in FIGS. 6 and 12, the first and second zone heating devices 46,48 each have a supporting frame 50 which is pivotally connected to a respective first and second carriage assembly 52,54 by a pivot pin 56,58 defining first and second axis 60,62 extending substantially parallel to each other and transverse to the sides 16,18 of the metal plate 14. It is to be noted that the first and second zone heating devices 46,48 are identical in construction therefore, unless otherwise specified, any discussion with respect to one will also relate to the other.

As best seen in FIG. 12, a drive means 71 is provided for moving the first and second heating devices 46,48 transversely relative to the plate edge 12. The drive means 71 includes first and second carriage assemblies 52,54 mounted on and movable along first and second trackways 64,66, respectively. Specifically, the first and second trackways 64,66 include a pair of spaced apart rails 68. The first and second carriage assemblies 52,54 each include a plurality of guide rollers rollingly engageable with the spaced apart rails 68 to effect linear translation of the first and second carriage assemblies 52,54 along the first and second trackways 64,66. As best seen in FIG. 12, the first and second trackways 64,66 are angled to provide a predetermined distance between the first and second zone heating devices 46,48 based on different diameter forming rollers 20. The drive means includes first-and second linear actuators 72,74 mounted on the support housing 40 and operatively connected to first and second carriage assemblies 52,54, respectively. The first and second linear actuators each have a cylindrical housing 76 and a movable member 78 disposed in the cylindrical housing and slidably movable therealong. The first and second zone heating devices 46,48 are movable towards the plate edge 12 in response to movement of their respective movable members 78. The drive means 71 includes first and second flexible members 80,82 trained over a plurality of sheaves 84 connected to the first and second carriage assemblies 52,54 of the first and second heating devices 44,46, respectively, and the movable members 78 of the first and second linear actuators 72,74, respectively.

Figure 3:
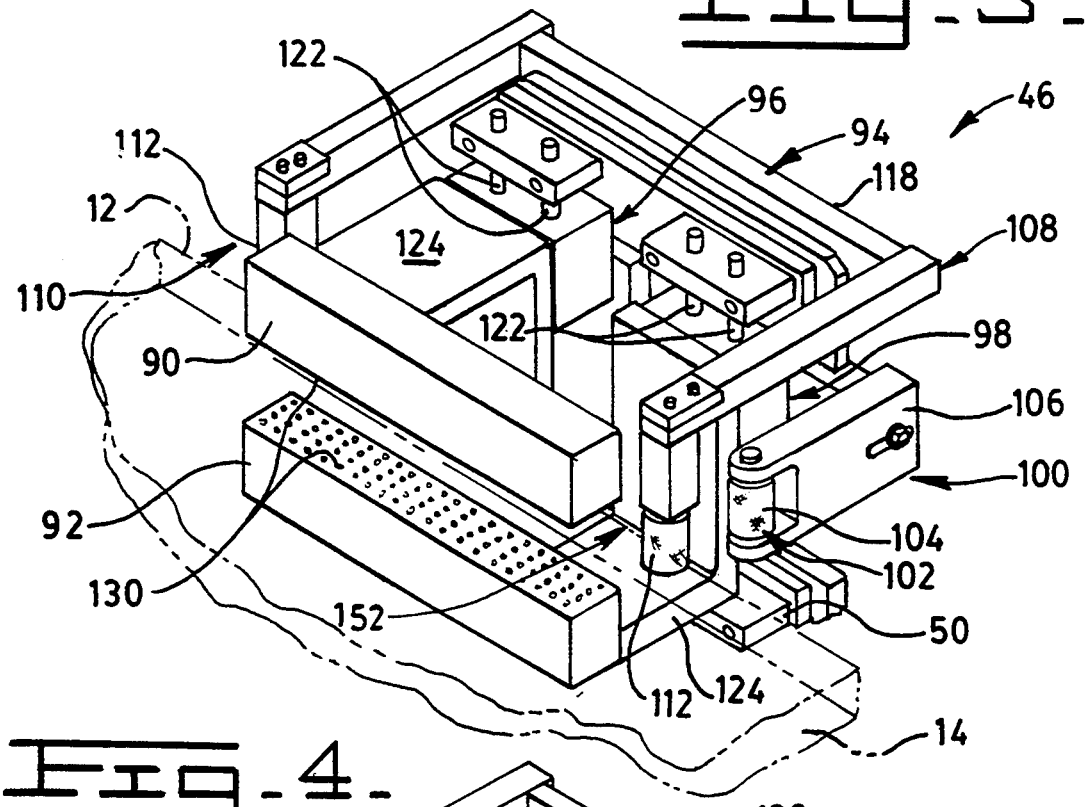
FIG. 3 is a diagrammatic isometric view of an embodiment of a heating device of FIG. 1 showing fixed and movable guides and first and second burners at a first position.
Figure 4:
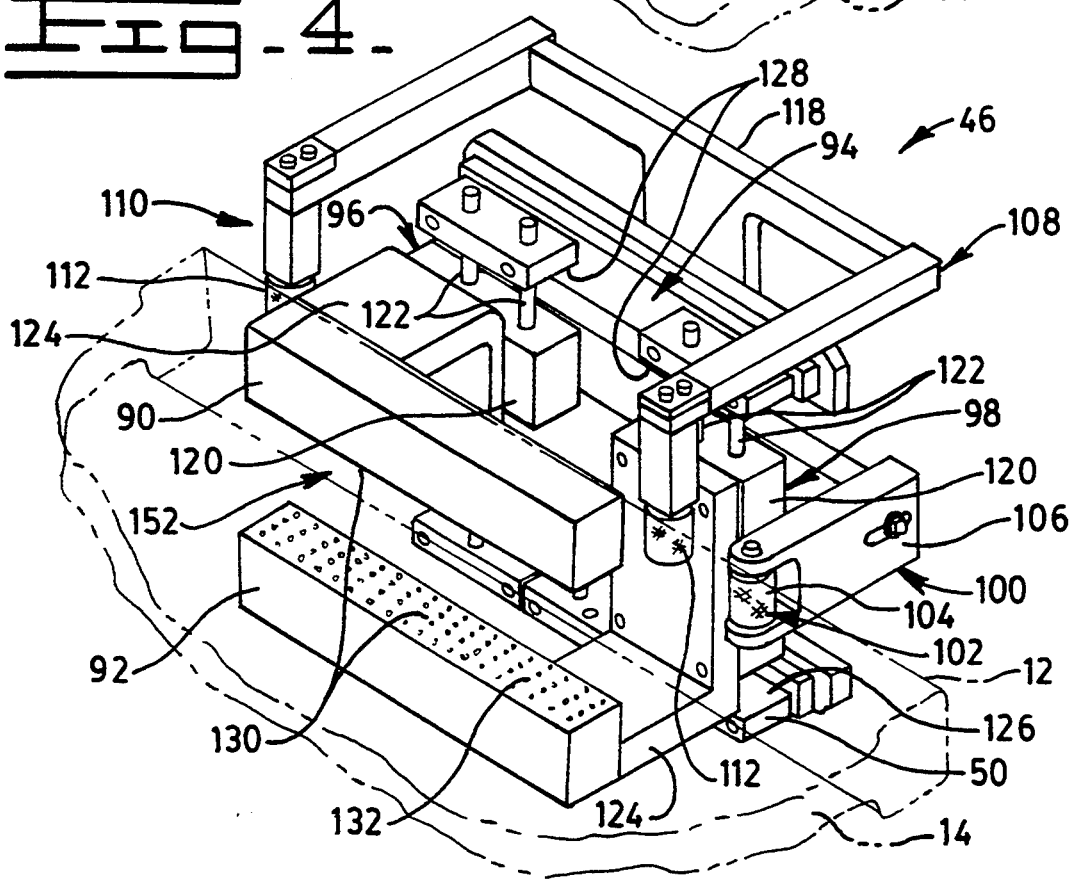
FIG. 4 is a diagrammatic isometric view of the heating device of FIG. 3 showing the burners at a second position.
Figure 5:
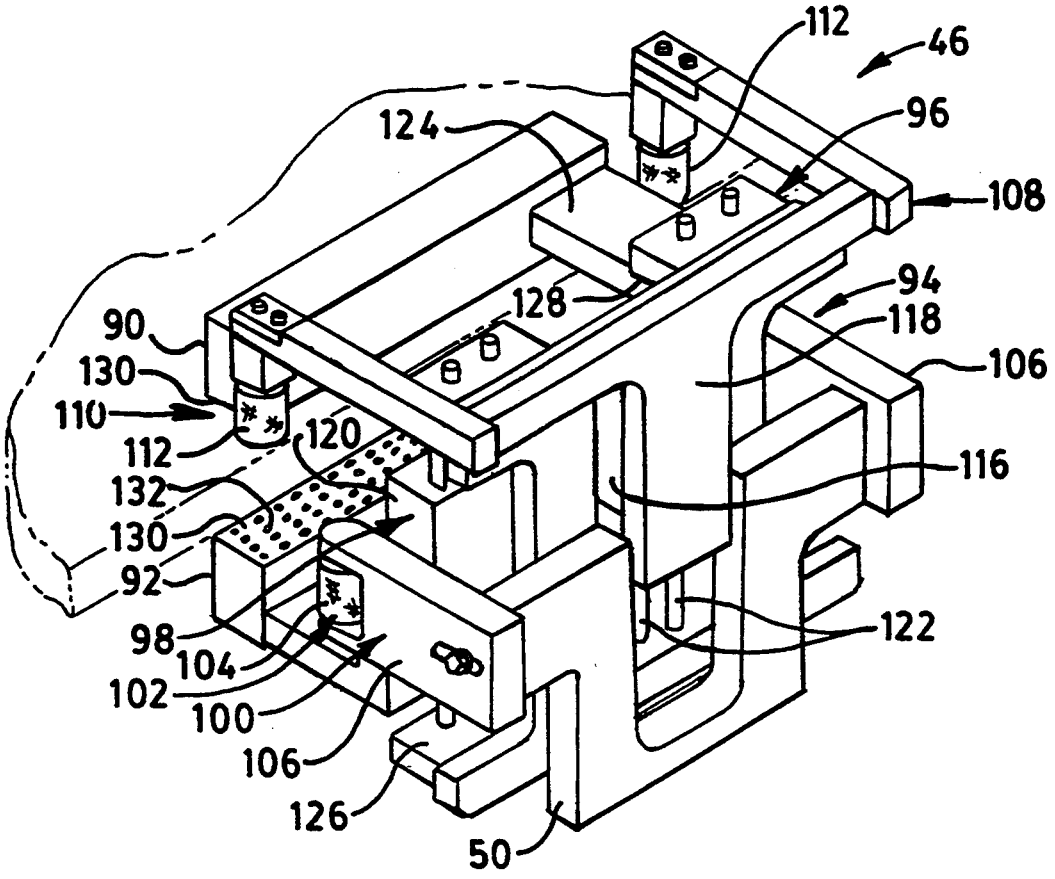
FIG. 5 is a diagrammatic isometric rear view showing the heating device of FIG. 4 in greater detail.
Figure 9:
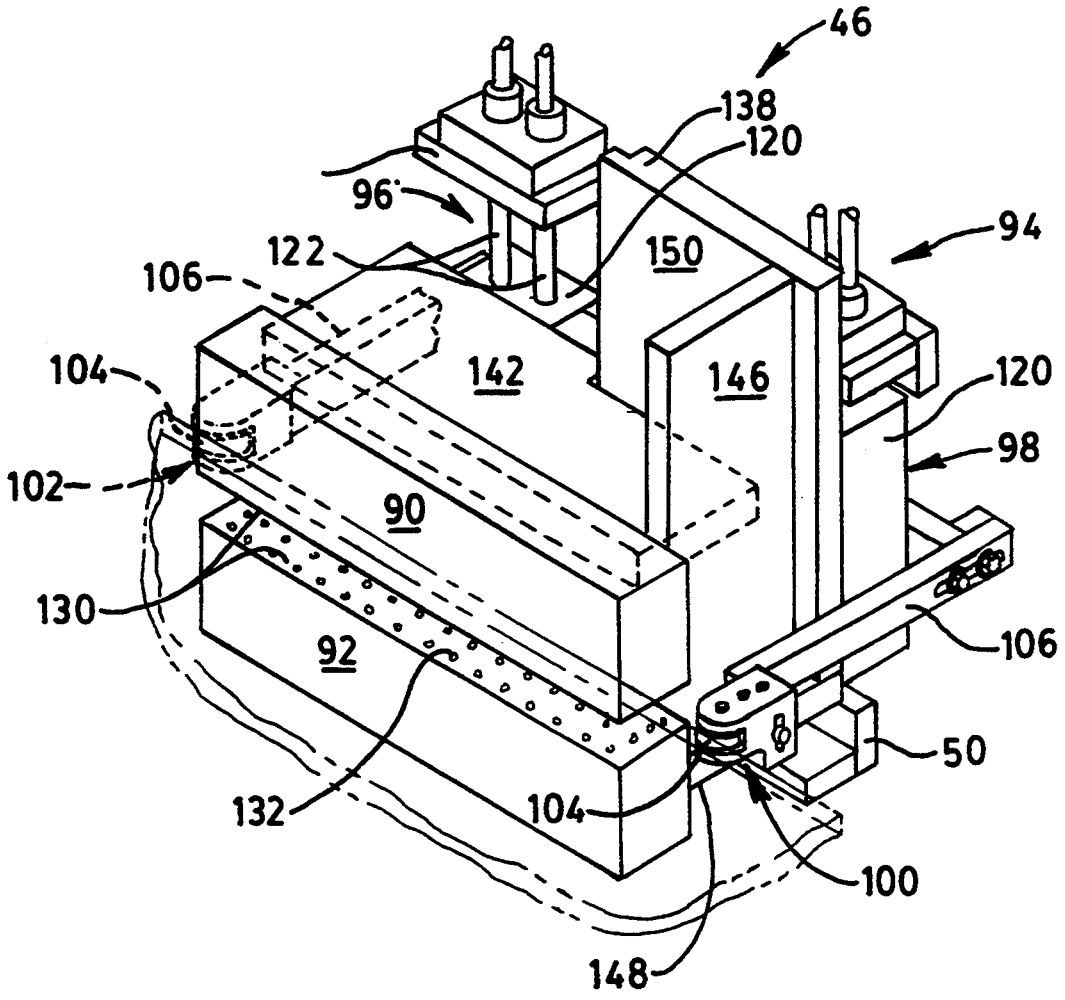
FIG. 9 is a diagrammatic isometric view of a modified embodiment of the heating device of FIG. 3 with the movable guide eliminated, a sliding heat shield added, and the burners at the first position.
Figure 10:
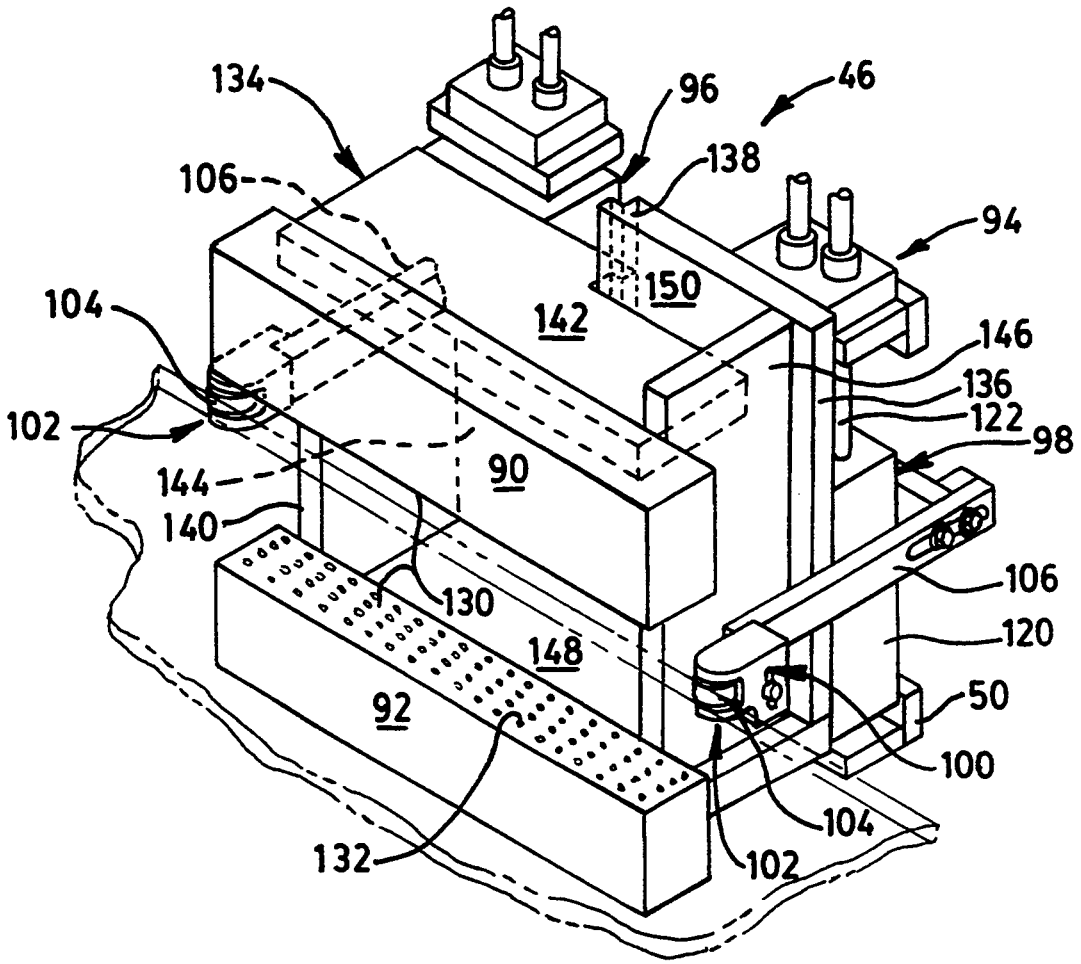
FIG. 10 is a diagrammatic isometric view of the modified embodiment of FIG. 6 with the burners at the second position.
Figure 11:
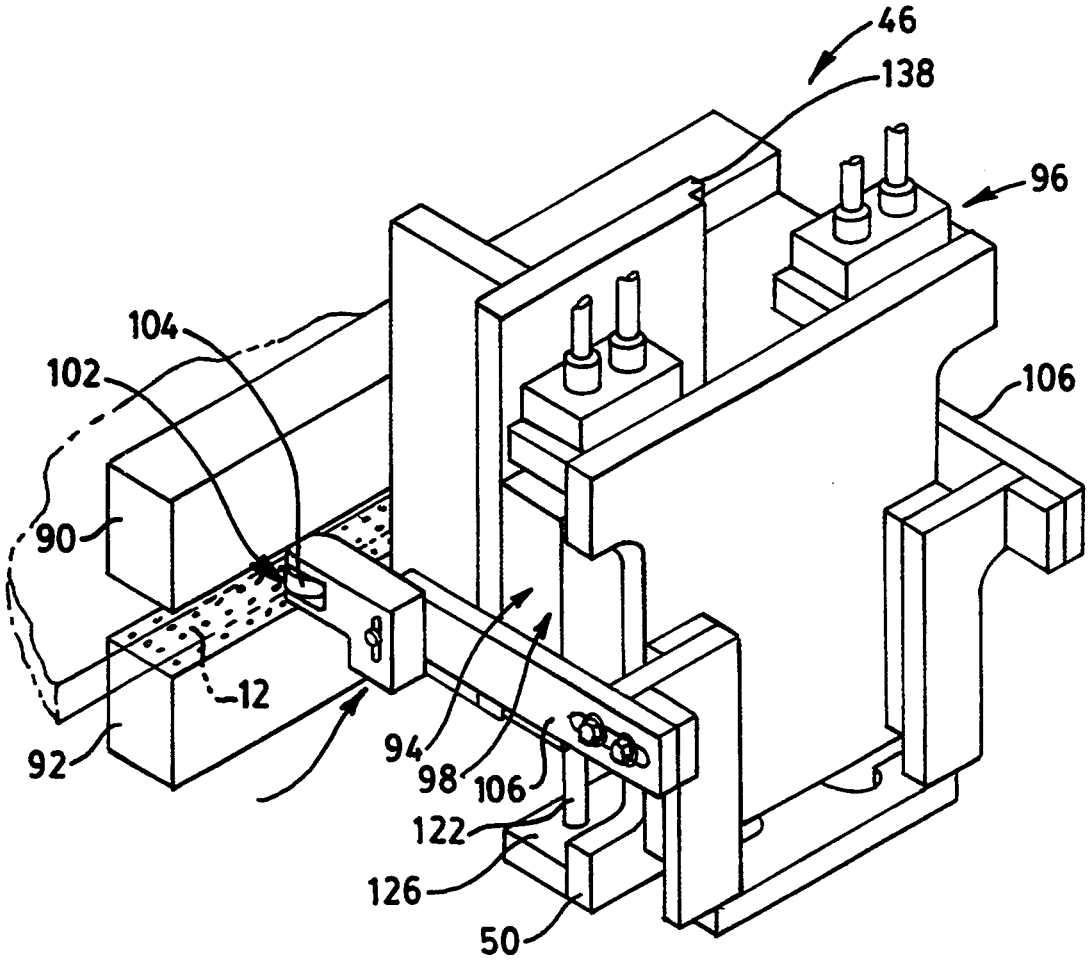
FIG. 11 is a diagrammatic isometric rear view of the heating device of FIG. 9 showing the modified embodiment of the heating device in greater detail.

FIGS. 3–5 disclose a first embodiment of the first zone heating device 46 and FIGS. 9–11 disclose a second embodiment of the first zone heating device 46. Since the first and second zone heating devices 46,48 of the first embodiment are identical and the first and second zone heating devices 46,48 of the second embodiment are identical only the first zone heating device 46 of the first and second embodiments will be discussed in any detail. Further, since the first and second embodiments of the first zone heating device 46 are similar in construction all similar structural elements will be numbered identically and different structural elements will be numbered differently.

Referring to the first zone heating device 46 as disclosed in the first embodiment of FIGS. 3–5 and the second embodiment of FIGS. 9–11. A first and second burner 90,92 are movably connected to the supporting frame 50 and movable between first and second predetermined transversely spaced heating positions relative to the first and second plate sides 6,18, respectively, of the plate 14 located therebetween. An actuating means 94 is provided for moving the first burner 90 between the first and second predetermined spaced heating positions relative to the first side 16 of the plate 14 and for moving the second burner 92 between the first and second predetermined spaced heating positions relative to the second side 18 of the plate 14. The actuating means 94 includes first and second linear actuators 96,98 respectively connected to the first and second burners, 90,92 and the supporting frame. The first linear actuator 96 is selectively actuatable to move the first burner 90 transversely relative to the first side 16 of the plate 14 between the first and second predetermined spaced heating positions and the second linear actuator 98 is selectively actuatable to move the second burner 92 transversely relative to the second side 18 of the plate 14 between the first and second predetermined spaced heating positions. Preferably, the first and second linear actuators 96,98 are fluid operated, such as by air.

A fixed guide means 100 is provided for maintaining the first and second burners 90,92 at a first predetermined transverse location relative to the plate edge 12. The fixed guide means 100 includes an engaging means 102 for engaging the plate edge 12. The engaging means 102 limits the amount of movement of the first and second burners 90,92 and the support frame 50, under the bias of the drive means 71, in directions towards the plate edge 12 and maintains the burners at the first predetermined transverse location relative to the plate edge 12. Specifically, the engaging means 102 includes a first pair of spaced substantially axially parallel fixed cylindrical guide rollers 104 rotatably connected to the supporting frame 50 by arms 106. The first pair of guide rollers 104 are rollingly engageable with the plate edge 12 which permits relatively smooth motion of the plate 14 and the burners 90,92. The arms 106 are adjustably connected to the support frame 50 by threaded fasteners disposed in an elongate slot in the arm 106 and screwthreadably connected to the support frame. This connection allows for adjustment of the first pair of guide rollers 104 relative to the burners and each other so that the transverse location of the burners 90,92 relative to the plate edge 12 can be modified to facilitate accurate positioning for plate 12 heating. This adjustment also determines the zone or area on the metal plate to be heated.

A movable guide means 108 is provided for maintaining the first and second burners 90,92 at a second predetermined transverse location relative to the plate edge 12. The second predetermined transverse location of the burners relative to the plate edge 12 is spaced from the first predetermined transverse location at a direction transverse the plate edge 12. Thus a second transverse zone heating position of the burners 90,92 relative to the plate edge 12 is provided. It is to be noted that only the first embodiment of FIGS. 3–5 includes a movable guide means 108.

The movable guide means 108, like the fixed guide means 100, includes an engaging means 110 for engaging the edge 12 of the plate 14. The drive means 71 urges the supporting frame towards the plate edge 12 and the engaging means 110 of the movable guide means 108 into engagement with the plate edge 12. The drive means 71 is of a construction sufficient to maintain a predetermined force on the support frame 50 and maintain the engaging means 110 against the plate edge 12. The engaging means 110 of the movable guide means includes a second pair of spaced substantially axially parallel cylindrical rollers 112 rotatably connected to the supporting frame 50. As shown in FIG. 3, the second pair of rollers 112 are engaged with the plate edge 12.

A third actuator means 114 is provided for moving the movable guide means 108 transversely relative to the first and second sides 16,18 of the metal plate between a first position at which the movable guide means is aligned to engage the plate edge 12 and a second position spaced from the first position at which the movable guide means 108 is spaced from being aligned to engage the plate edge 12. As shown in FIG. 3, the movable guide means 108 is engageable with the plate edge 12 at the first position and prevents engagement between the plate edge 12 and the engaging means 102 of the fixed guide means 100. The engaging means 102 and 110 are both aligned to engage the plate edge 12 at the first position of the engaging means 110. Thus, the movable guide means 108 prevents engagement of the fixed guide means 100 with the plate 14 at the first position of the movable guide means 108 since the engaging means 110 are positioned to engage the plate before engaging means 102.

The actuating means 114 includes a third linear actuator 116 connected to and between the supporting frame 50 and the movable guide means 108. Specifically, the movable guide means 108 includes a roller frame 118 which is connected to the third linear actuator 116. The roller frame 118 which carries the second pair of rollers 112 is movable in response to movement of the third linear actuator 116 to move the second pair of rollers 112 between the first and second transverse positions relative to the first and second plate sides 16,18.

The first, second and third linear actuators 96,98 and 116 each have a housing 120 and a pair of spaced substantially parallel rods 122. The housings 120 of the first and second linear actuators are connected to the first and second burners 90,92 and the housing of the third linear actuator 116 is connected to the roller frame 118. The pair of rods 122 of each of the first, second and third linear actuators 96,98 and 116 are connected to the supporting frame 50. It should be noted that the connections heretofore discussed with respect to the first, second and third linear actuators could be reversed and the housings 120 be rigidly connected to the supporting frame 50 and the rods 122 connected to the first and second burners 90,92 and the roller frame 118. The burners 90 and 92 of FIGS. 3, 4, and 5 are connected to the housings 120 by L-shaped brackets 124. As shown in FIG. 5, the housing 120 is connected to the roller frame 118.

In the first and second embodiments of FIGS. 3–5 and 9–11, the supporting frame 50 includes first and second end portions 126,128 which are spaced a predetermined distance apart. The housings 120, each of a preselected length are movable along the rods 122 between the first and second end portions 126,128 of the supporting frame. The first and second positions of the first and second heating members is a function of the magnitude of movement of the respective housings 120 between the first and second end portions 126,128 of the supporting frame 50. Thus, the first and second end portions 126,128 and the distance therebetween define the maximum amount of movement of the housings 120 of the first and second linear actuators 96,98. Also, the first and second housing end portions define the maximum amount of movement of the housing of the third linear actuator 116 and the first and second positions of the movable guide means 108. Adjustment screws, or the like, connected to the end portions 126,128 of the supporting frame can be provided to adjust the travel and position of the housing. The first and second burner positions thus may be changed based on the thickness and material composition of the metal plate.

The first and second burners 90,92 each have a side 130 and a plurality of orifices 132 opening at the side.

The side 130 of the first burner 90 faces the plate first side 16 and the side 130 of the second burner faces the plate second side 18. Therefore the sides 130 of the first and second burners 90,92 face each other.

With reference to FIGS. 9–11, a heat shield having first and second shield portions 134,136 is disposed between the burners 90,92 and the linear actuators 96,98. The first shield portion 134 is connected to and movable with the first burner 90 and the second shield portion 136 is connected to and movable with the second burner 92. The first and second shield portions 134,136 have overlapping portions 138 which restrict the transfer of heat from the first and second burners 90,92 to the first and second linear actuators 96,98. The first shield portion has a side plate 140 connected to the first burner, a top plate 142 connected to the side plate 140 and a back plate 144 connected to the side plate 140. The second shield portion 136 has a side plate 146 connected to the second burner 92, a bottom plate 148 and a rear plate 150 each connected to the side plate 146. The rear plates 144,150 each have an elongated edge portion extending along the length of the edge of each of the rear plates and defining the overlapping edge portions 138. The side plates 140,146 are spaced from each other and the top and bottom plates 142,148 are spaced from each other. The overlapping edge portions 138 are slidably engaged with each other and permit relative motion of the first and second burners 90,92. Thus it can be seen that the first and second shield portions eliminate the need for the brackets 124 of the first embodiment, as shown in FIGS. 3–5, and serve to prevent excessive heat from transferring to the first, second and third linear actuators 96,98 and 116.

Figure 7:
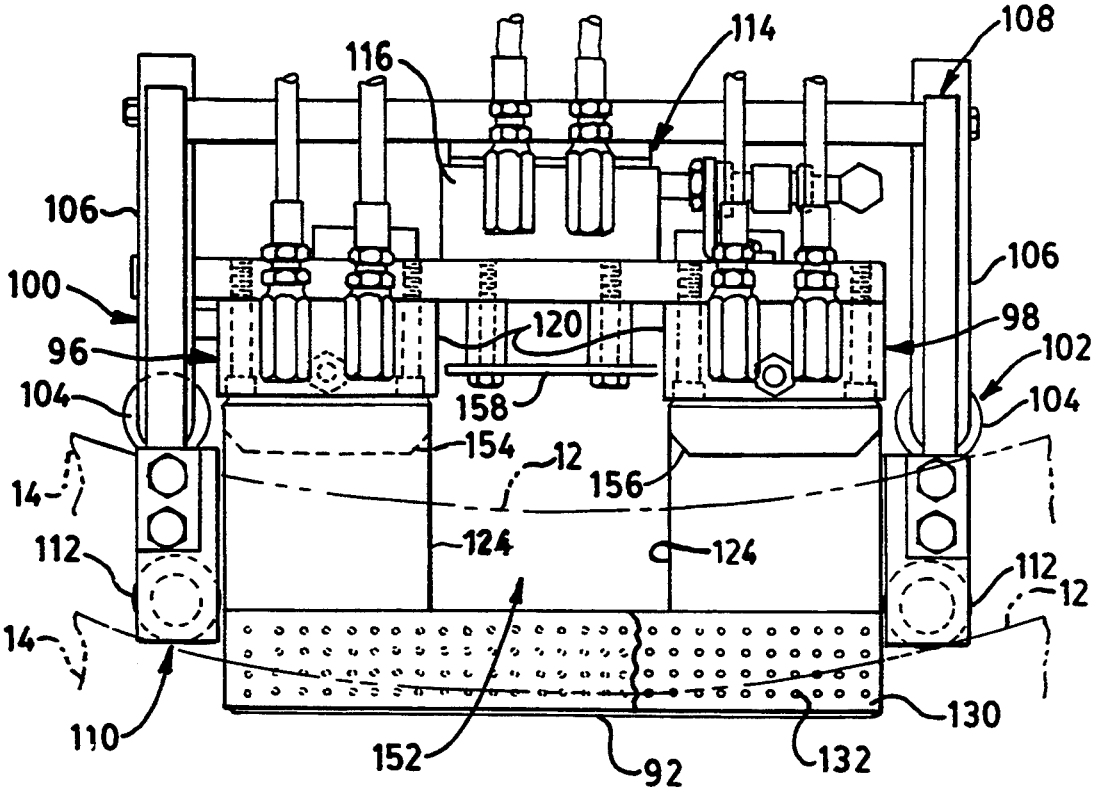
FIG. 7 is a top elevational view taken along lines 7—7 of FIG. 6.

FIGS. 6 and 7, the front and top views of the first embodiment of FIGS. 3–5, show a heat shield 152. The heat shield 152 includes a first stainless steel sheet shield portion 154 connected to overlay the bracket 124 of the first burner 90, a second stainless steel sheet shield portion 156 connected to overlay the bracket 124 of the second burner 92, and an intermediate stainless steel sheet shield portion 158 connected to the support frame 50 at a location between the first and second shield portions 154,156. Each of the first, second, and intermediate shield portions 154,156 and 158 are elongated. The first and second shield portions 154,156 are preferably substantially "L" shaped. It should be noted that the brackets 124 themselves may be constructed to provide heat shielding and contain water cooling passages (not shown). Thus, the first and second heat shield portions 154,156 would be eliminated. The heat shield 152 shields the first, second and third linear actuators 96,98 and 116 and associated conduits, sensors and the like from excessive heat.

Figure 8:
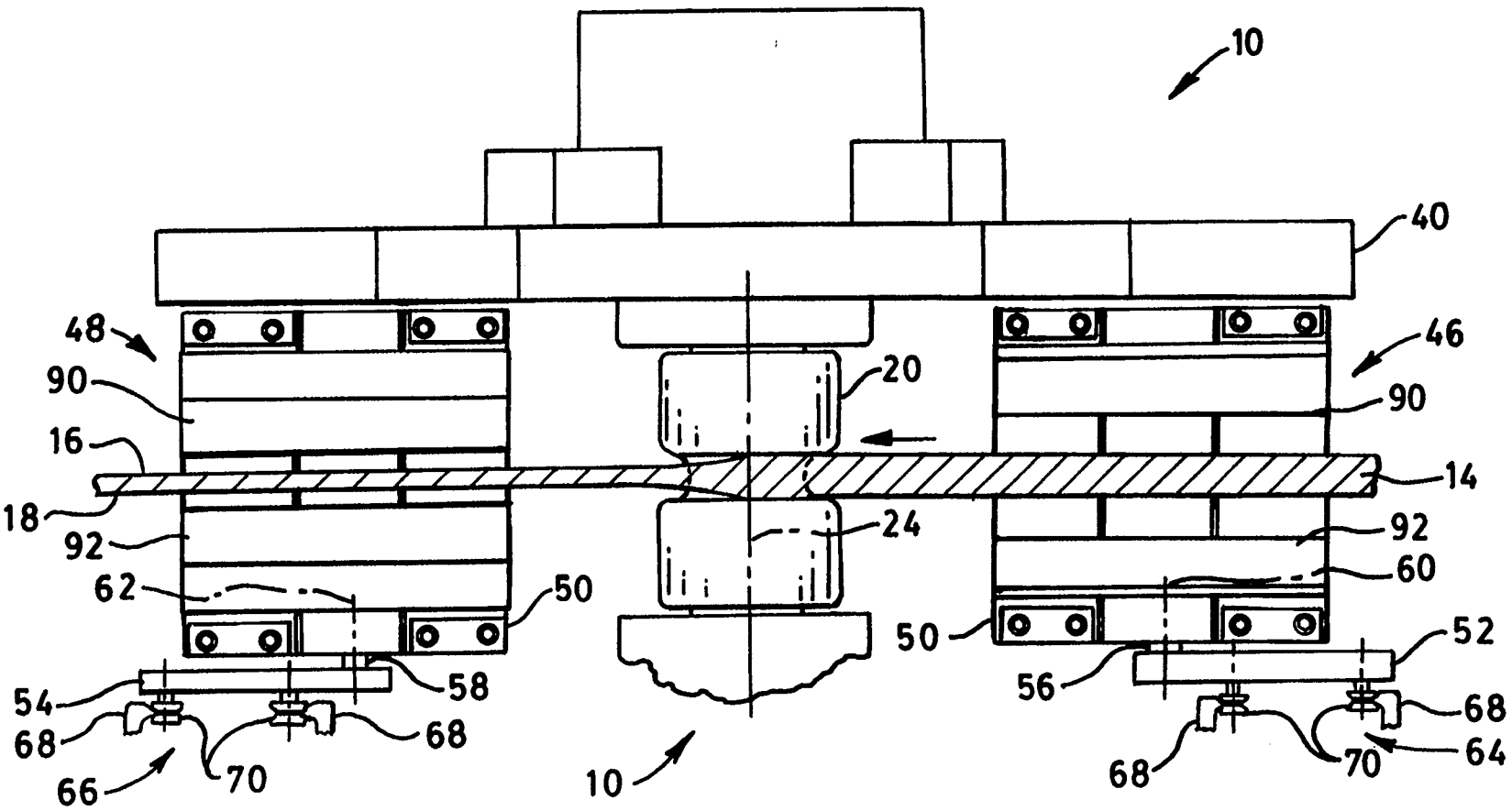
FIG. 8 is a diagrammatic elevational view taken along lines 8—8 of FIG. 2 showing the relative position of the first and second zone heating devices and a forming roller.

Referring to FIG. 8, the forming apparatus 10 is shown upsetting-a metal plate along the plate edge 12 by moving the forming roller 20 in the direction of the arrow relative to the plate material 14. The first and second zone heating devices 46,48 are shown with the first and second burners 90,92 of the second heating device 48 at the first position and the first and second burners 90,92 of the first heating device at the second position. At these positions, the first and second burners 90,92 of the second heating device 48 is set to heat the metal plate 14. The pivotal connection of the carriage assemblies 52,54 to the supporting frame 50 of the first and second zone heating devices 46,48 in combination with the urging by the drive means 71 toward the plate edge 12 maintains a selected one of the fixed and movable guide means 100,108 in engagement with the plate edge 12 so that a predetermined zone (area) of the metal plate relative to the plate edge 12 is heated during upsetting of the plate edge 12. The pivotal connection of the first and second zone heating devices 46,48 to the first and second carriages 52,54, respectively, permits the first and second zone heating devices 46,48 to follow in a regular or intermittent edge and thereby ensure that the first and second burners 90,92 are maintained at a desired transverse location relative to the plate edge 12. It is to be noted that in applications where the plate has a straight edge 12 the drive means 71 may position the first and second zone heating devices 46,48 at a predetermined location relative to the plate edge 12 at which the fixed and movable guide means 100,108 are spaced from the edge 12 and free from engagement therewith. The forming roller 20, as shown in FIG. 8, has a groove defining the configuration and thickness of the plate edge being formed.

As best seen in FIG. 6, a plurality of substantially axially parallel axles 160 connect the first and second pairs of guide rollers 104,112 to the supporting frame 50. The axles 160 are cylindrical and substantially parallel to their respective pivot axis 60,62. The first and second pairs of rollers 104,112 are rotatably connected to the axles 160.

The first pair of rollers 104 of the fixed guide means 100 is spaced from the first and second burners 90,92 a distance greater in magnitude than the distance of the second pair of rollers 112 of the movable guide means 108 from the first and second burners 90,92. Thus, the first pair of rollers 104 of the fixed guide means 100 maintains the first and second burners 90,92 at a greater distance from the edge 12 than the second pair of rollers 12 of the movable guide means 108.

Figure 13:
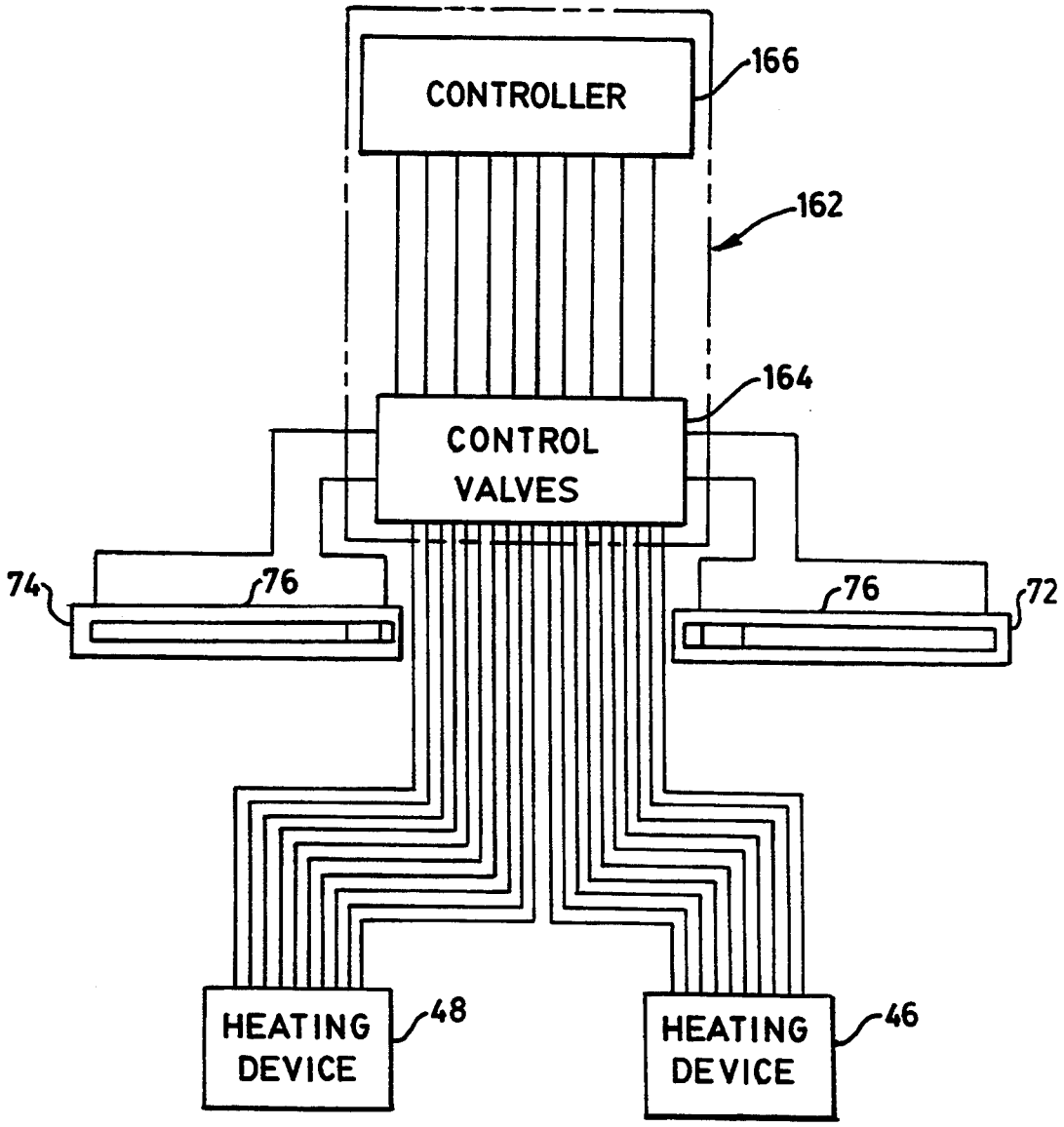
FIG. 13 is a schematic representation of the control system for moving the first and second heating devices: transversely relative to the plate edge, the first and second burners transversely relative to the plate sides, and the movable guide between the first and second positions.

With reference to FIG. 13, a control means 162 is provided for selectively delivering pressurized fluid flow to the first and second linear actuators 72,74. The control means 162 preferably includes a plurality of control valves 164 connected to the first and second linear actuators 72,74 by conduits. The control valves 164 are adapted to deliver pressurized fluid flow from a source not shown to opposite ends of the cylindrical housing 76 in order to shift the movable member 78 in a desired linear direction relative to the cylindrical housing 76 and to control the force applied by the actuator. Others of the plurality of control valves 164 are connected to the first, second and third linear actuators 96,98 and 116 and selectively direct pressurized fluid flow from a source not shown to selected ones of first, second and third linear actuators 96,98 and 116. The linear actuators 96,98 and 116 are movable in response to receiving said fluid flow to move said first and second burners 90,92 and said movable guide means 108 between said first and second positions. The plurality of control valves 164 which are preferably electrically actuated are movable between first and second positions to control the direction of fluid flow and thereby control the direction of movement of the first and second burners 90,92 and the movable guide means 108. The control valves 164, for example, are solenoid operated three position two way pneumatic control valves.

The control means 162 includes a controller 166 having a processor for executing preprogrammed instructions stored in memory (not shown). The controller 166 based on preprogrammed instructions stored in memory and external inputs from a keypad and the like, not shown, controls actuation of the control valves to achieve the desired positioning of the first and second burners 90,92, the movable guide means 108 of the first and second zone heating devices 46,48, and the first and second linear actuators 72,74 (which positions the first and second zone heating devices 46,48 relative to the plate edge 12). It should be noted that the controller may also control the flow of cooling water to the first and second burners 90,92 and the mixture and flow of combustible gasses delivered to the first and second burners 90,92.

Figure 14:
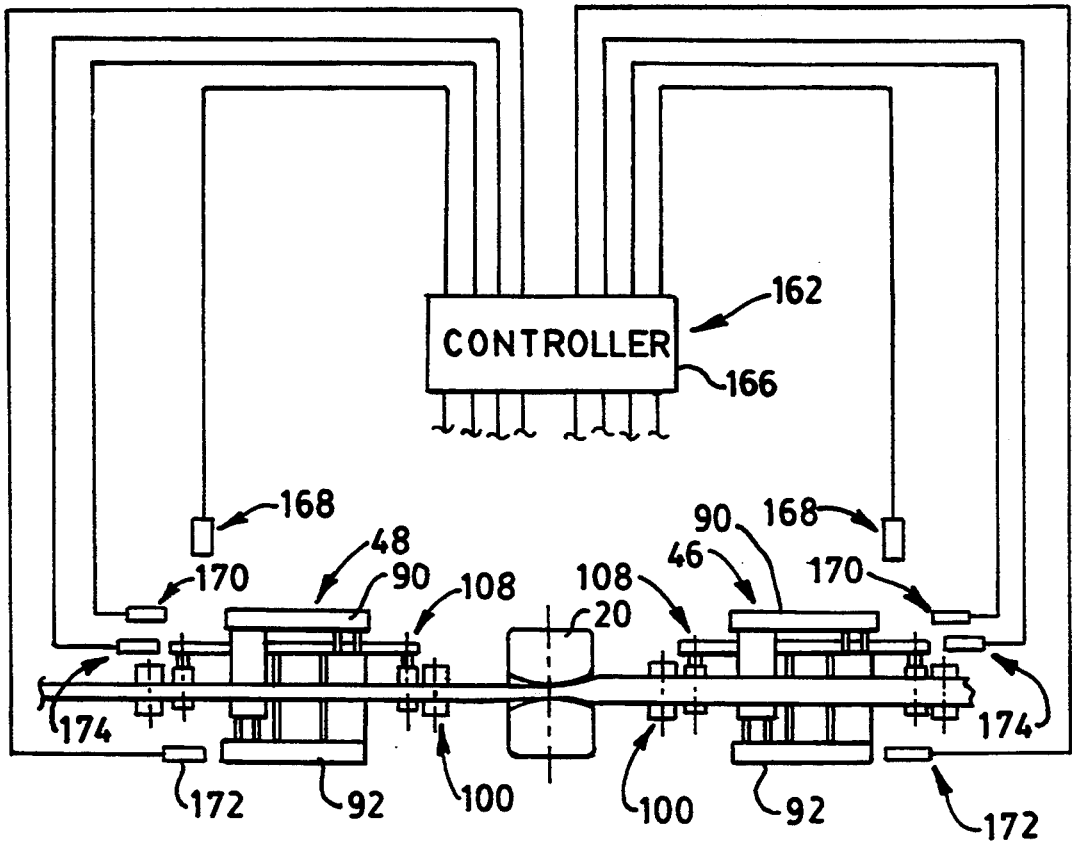
FIG. 14 is a schematic representation of the control system for sensing the position of the first and second heating devices, the first and second burners:, and the movable guide.

Referring to FIG. 14, means 168 is provided for sensing the position of the fixed guide means 100 of the first and second zone heating devices 46,48 and responsively delivers a guide position signal at the first position of the fixed guide means 100. The sensing means 168 is connected to control means 162. The controller 166 receives the guide position signal and delivers a control signal in response thereto. The drive means 71 receives the control signal and stops transverse movement of at least one of the first and second zone heating devices 46,48 transversely relative to the plate edge 12 in response to receiving the control signal. This response is based on preprogrammed instructions stored in the memory of the controller 166. The sensing means 168 may be of any suitable type including proximity, air, and the like.

A first burner sensing means 170, a second burner sensing means 172 and a movable guide sensing means 174 are each connected to the control means 162. The first burner sensing means 170 senses the position of the first burner and delivers a signal related thereto. Likewise, the second burner sensing means 172 senses the position of the second burner 92 and delivers a related second burner position signal. The movable guide sensing means 174 senses the position of the movable guide means 108 and delivers a signal related to the position of the movable guide means 108. Preferably, the first burner sensing means 170 delivers a signal at the first position of the first burner 90 and the second burner sensing means 172 delivers a signal in response to the second burner 92 being at the first position. The control means 162, as previously indicated, executes the preprogrammed instructions and commands movement of the burners 90,92, movement of the movable guide means 108, and movement of the first and second heating devices 46,48 transversely relative to the plate edge 12. The control means 162 delivers a signal to the actuating means 94 which moves the first and second burners 90,92 from the first position to the second position prior to the control means 162 delivering a signal to the drive means 71. Thus the first and second burners 90,92 are moved to clear an enlarged formed edge prior to the drive means 71 being commanded to move the first and second heating devices 46,48 to a location at which the fixed guide means 100 is spaced from the plate edge 12 and the first and second heating devices are transversely spaced from the plate edge. The first and second burner sensing means 170,172 provides signals to the controller 166 necessary to ensure that the burners are open and at the second position before transverse movement of the first and second zone heating devices 46,48 is permitted. Thus, damage to the burners 90,92 causes by interference with the plate is prevented.

The control means 162 also controls movement of the power means 30. As can be appreciated, reciprocal movement of the metal plate 14 relative to the forming roller 20, positioning of the first and second zone heating devices, positioning of the first and second burners 90,92, and positioning of the movable guide means 108 requires synchronization to achieve satisfactory results. The control means 162 provides such functions and ensures that the proper sequence of operation takes place.

Industrial Applicability

With reference to the drawings, the forming apparatus 10 and particularly the forming roller 20 forms a thickened edge along the edge 12 of the metal plate 14. The metal plate being securely clamped to the table 26 yields to the force of the forming roller resulting in upsetting of the edge 12 to the thickened edge. The configuration of the edge being formed is the function of the shape of the roller 20. The power means 30 forces movement of the forming roller 20 relative to the metal plate in both the X and Y coordinate directions. The power means 30 is under control of the control means 162 which is programmed to cause the forming roller 20 to follow a path located in the X,Y coordinate plane related to the profile of the edge 12. Thus the roller 20 is movable under the dynamic control of the control means 162 to form a contour, intermittently or continuously along a straight or irregular shaped plate edge 12. Since the control means 162 is programmable, the position of the roller 20 relative to the metal plate 14 can be changed to accommodate various thicknesses and shapes of metal plates 12.

The first and second zone heating devices 46,48 are movable in the X,Y plane along the first and second trackways 64,66, respectively, to a predetermined location relative to the plate edge 12, in the case of a straight edge, or into engagement with the plate edge 12, in the case of an irregular shaped edge. In order to ensure that either the fixed or movable guide means 100,108 is maintained in engagement with the plate edge 12 a predetermined amount of force generated by the first and second linear actuators 72,74 is applied to the first and second carriage assemblies 52,54 which forces the first and second zone heating devices 46,48 toward the plate edge 12. As the roller 20 formingly moves along the plate edge 12 the combination of one of the fixed and movable guide means 100,108 against the edge 12 and the biasing force applied by the first and second linear actuators 72,74 thereto will cause the first and second zone heating devices 46,48 to pivot about their respective first and second axis 60,62 to maintain the first and second burners 90,92 at the desired location relative to the plate edge 12.

The first and second burners 90,92 of the first and second zone heating devices 46,48 are placed at one of the first and second transversely spaced locations relative to the first and second sides 16,18 of the metal plate as determined by the thickness of the plate stock being formed and the amount of heat required to raise the temperature of the metal plate to a predetermined temperature so that the upsetting force is reduced to an acceptable magnitude. The burners 90,92 are preferably lit when at the first position relative to the plate sides 16,18, that is the position closest to the sides of the 16,18 of the metal plate 14. It has been determined that the burners 90,92 would be off at the second position. However, under certain circumstances, the burners may be on even at the second position in order to maintain the metal plate 14 at a predetermined threshold temperature. It is to be noted that a combination of burners 90,92 to be ignited is a function of the material and thickness of the metal plate 14 being formed. One or more of the first and second burners 90,92 may be required to heat and maintain the metal plate at the desired forming temperature. The control means 162, based on preprogramming instructions which takes into account the shape and thickness and material of the metal plate being formed, executes the preprogrammed instructions and delivers control signals to the control valves 164, as previously discussed, for controlling the various actuators 72,74,96,98,116 and to achieve the desired end results.

The first and second burners 90,92 are normally moved to the second position in order to provide adequate clearance relative to the thickened edge of the plate 14 so that the burners are free from engagement with the thickened edge during transverse movement relative to the plate edge 12 in a direction away from the metal plate. Should any of the first and second burners 90,92 be at the first position during transverse movement relative to the plate edge, the potential for damage to the burners 90,92 is possible. Thus, the first and second burners sensing means 170,172 provides the necessary feedback to prevent the control means 162 from moving the first and second zone heating device 46,48 transverse to plate edge while at this position.

Optionally, the movable guide means 108 may be provided to control the transverse position of the first and second burners 90,92 relative to the plate edge 12. Specifically, the movable guide means 108 provides another location different from the location provided by the fixed guide means 100 so that additional options and combinations of zone heating locations can be obtained. Should the location defined by the movable guide means 108 be selected, the control means 162, based on preprogrammed instructions, moves the movable guide means 108 to the first position and the associated first and second zone heating device 46,48 into the first position transverse the plate edge. This position is established by engagement between the plate edge 12 and the movable guide means 108.

From the above discussion it should be recognized that the first and second zone heating devices 46,48 heat the metal plate to a desired temperature and maintains the metal plate at the desired temperature during single or reciprocal passes of the roller 20 relative to the metal plate 14 so that the thickened edge may be upset with a reduced amount of force. Thus, the life of the forming roller is improved and the energy required to achieve thickened edge forming is reduced.

Other aspects, objects and advantages of the present invention can be obtained from a study of the drawings, the disclosure and the appended claims.

We claim:

1. A zone heating device for heating a predetermined area of a metal plate relative to an edge of the metal plate during upsetting of the edge, said plate having first and second spaced sides; comprising:

a supporting frame having a pivot axis oriented transverse the plate first and second sides, said supporting frame being pivotally movable about the pivot axis;

a first burner connected to said supporting frame and movable between first and second predetermined transversely spaced heating positions relative to the first side of said plate;

a second burner movably connected to said supporting frame and movable between first and second predetermined transversely spaced heating positions relative to the second side of said plate, said plate being located between the first and second burners; and actuating means for moving the first burner between said first and second predetermined spaced heating positions relative to the first side of the plate and for moving the second burner between first and second predetermined spaced heating positions relative to the second side of said plate.

2. A zone heating device, as set forth in claim 1, including fixed guide means for maintaining said first and second burners at a first predetermined transverse location relative to the plate edge, said fixed guide means being connected to the supporting frame.

3. A zone heating device, as set forth in claim 2, wherein said fixed guide means includes means for engaging the edge of said plate.

4. A zone heating device, as set forth in claim 3, including drive means for urging said supporting frame in a direction toward said plate edge.

5. A zone heating device, as set forth in claim 3, wherein said engaging means of the fixed guide means includes a first pair of spaced substantially axially parallel rollers rotatively connected to said supporting frame and engagable with the plate edge.

6. A zone heating device, as set forth in claim 4, including a movable guide means for maintaining the first and second burners at a second predetermined transverse location relative to the plate edge, said second predetermined transverse location of the burners relative to the plate edge being spaced from said first predetermined transverse location of the burners relative to the plate edge in a direction transverse the plate edge, said movable guide means being movably connected to the supporting frame.

7. A zone heating device, as set forth in claim 6, wherein said movable guide means includes means for engaging the edge of said plate, said drive means urging said supporting frame toward said plate edge and the engaging means of the movable guide means into engagement with the plate edge.

8. A zone heating device, as set forth in claim 7, wherein said engaging means of the movable guide means includes a second pair of spaced substantially axially parallel rollers rotatively connected to said supporting frame, said second pair of rollers being engagable with the plate edge.

9. A zone heating device, as set forth in claim 8, wherein said second pair of rollers being movable transversely relative to the first and second plate sides between a first position at which the second pair of rollers is aligned to engage the plate edge and a second position spaced from the first position at which said second pair of rollers is spaced from being aligned to engage the plate edge.

10. A zone heating device, as set forth in claim 8, wherein said engaging means of the fixed guide means includes a first pair of spaced substantially axially parallel rollers rotatively connected to said supporting frame and engagable with the plate edge, said first and second roller pairs being spaced from each other.

11. A zone heating device, as set forth in claim 10, wherein said first pair of rollers is spaced from the first and second burners a distance greater in magnitude than the distance of the second pair of rollers from first and second burners.

12. A zone heating device, as set forth in claim 10, including a plurality of substantially axially parallel axles connected to the supporting frame, said axles being substantially parallel to the pivot axis, said first and second pairs of rollers being rotatively connected to the axles.

13. A zone heating device, as set forth in claim 7, including a third linear actuator connected to said supporting frame and said movable guide means, said third linear actuator being adapted to move the movable guide means transversely relatively to the first and second plate sides between a first position at which said engaging means of the movable guide means being aligned to engage the plate edge and a second position spaced from the first position at which said movable engaging means of the movable guide means is spaced from engagable alignment with the plate edge.

14. A zone heating device, as set forth in claim 13, said third linear actuator being fluid operated, and including control means for selectively delivering pressurized fluid flow to said third linear actuator and moving said movable guide means between said first and second transverse positions relative the first and second plate sides.

15. A zone heating device, as set forth in claim 15, wherein said third linear actuator including a pair of spaced substantially parallel rods connected to the supporting frame and a housing slidably connected to the third linear actuator rods, said movable guide means being connected to the housing and movable between said first and second positions in response to movement of the housing of the third linear actuator along the rods of the third linear actuator.

16. A zone heating device, as set forth in claim 15, wherein said supporting frame has first and second end portions, said first and second end portions defining the maximum amount of movement of the third linear actuator and the first and second positions of the movable guide means.

17. A zone heating device, as set forth in claim 1, including a heat shield having first and second shield portions disposed between the burners and the linear actuators, said first shield portion being connected to and movable with the first burner and said second shield portion being connected to and movable with the second burner, said first and second shield portions having overlapping edge portions, said overlapping edge portions restricting the transfer of heat from the burners to the first and second linear actuators.

18. A zone heating device, as set forth in claim 17, wherein said first shield portion having a side plate connected to one of the first and second burners, a top plate connected to the side plate, and a rear plate connected to said side plate, said second shield portion having a side plate connected to the other of said first and second burners, a bottom plate and a rear plate each connected to the side plate of the second shield portion, said rear plates of the burners each having said overlapping edge portion, said overlapping edge portions extending along said rear plates and defining a lap type joint, said side plates being spaced from each other, and said top and bottom plates being spaced from each other.

19. A zone heating device, as set forth in claim 18, wherein said overlapping edge portions being slidably engaged with each other.

20. A zone heating device, as set forth in claim 1, wherein said actuating means includes first and second linear actuators respectively connected to said first and second burners, and said supporting frame, said first and second linear actuators being actuatable, respectively, to move the first burner transversely relative to the first side of the plate between said first and second predetermined spaced heating positions, and the second burner transversely relative to the second side of the plate between said first and second predetermined spaced heating positions.

21. A zone heating device, as set forth in claim 20, wherein said first and second linear actuators are fluid operated and including control means for selectively delivering pressurized fluid flow to the first and second linear actuators.

22. A zone heating device, as set forth in claim 20, said first and second burners each having a side, a bracket, and a plurality of orifices opening at said side, said side of the first burner facing the plate first side, said side of the second burner facing the plate second side, and said sides of the first and second burners facing each other, said first and second linear actuators each having a housing and a rod slidably connected to the housing, one of the rod and housing of the first linear actuator being connected to the bracket of the first burner and the other of the rod and housing of the first linear actuator being connected to the supporting frame, and one of the rod and housing of the second linear actuator being connected to the bracket of the second heating member and the other of the rod and housing of the second linear actuator being connected to the supporting frame.

23. A zone heating device, as set forth in claim 22, wherein said supporting frame includes first and second end portions spaced a predetermined distance apart, said housings having a preselected length and being movable along said rods between the first and second end portions of the supporting frame, said first and second positions of the first and second heating members being a function of a magnitude of movement of the respective housing between the first and second end portions of the supporting frame.

24. A zone heating device, as set forth in claim 1, wherein said supporting frame having a base, a carriage, and a shaft pivotally connecting the base to the carriage, said shaft defining said supporting frame pivot axis, and including:

a plurality of spaced guide members mounted on said carriage; and track means for engaging said guide members and guiding movement of said supporting frame in directions transverse relative to the plate edge.

25. A zone heating device, as set forth in claim 24, wherein said guide members include a plurality of guide rollers.

26. A zone heating device, as set forth in claim 24, including drive means for moving said supporting frame to a location at which said first and second burners are at a preselected transverse distance relative to the plate edge, said drive means being connected to said carriage.

27. A zone heating device, as set forth in claim 26, including guide means connected to the supporting frame for engaging the plate edge and maintaining the first and second burners at the preselected transverse location relative to the plate edge.

28. An apparatus for selectively forming a thickened edge along an edge of a metal plate having first and second sides, comprising:

a metal plate forming roller having a longitudinal axis of rotation and being forcibly engagable with an edge of a metal plate, said longitudinal forming roller axis being oriented transversely relative to the first and second sides of the metal plate;

power means for reciprocally moving one of the metal plate and the forming roller transverse the forming roller axis, said forming roller upsetting at least a portion of the edge along the metal plate into a thickened edge during said relative reciprocating movement;

a first zone heating device having a supporting frame and a first burner movably connected to the supporting frame, said first burner being movable relative to the supporting frame between a first position at which said first burner is spaced a preselected first transverse distance from the first side of the metal plate and a second position at which the first burner is spaced a second preselected transverse distance from the first side of the metal plate;

a second zone heating device having a supporting frame and a first burner, said first burner of the second zone heating device being movable relative to the supporting frame of the second zone heating device between a first position at which said first burner of the second zone heating device is spaced a first preselected transverse distance from the first side of the metal plate and a second position at which the first burner of the second zone heating device is spaced a second preselected transverse distance from the first side of the metal plate;

first actuator means for moving the first burner of each of the first and second heating devices between said first and second spaced positions;

drive means for moving said first and second heating devices transversely relative to said plate edge;

fixed guide means for engaging the edge of said metal plate and maintaining the first burner of the first and second zone heating devices at a predetermined first transverse distance spaced from the edge of the metal plate, said fixed guide means being connected to the supporting frame of the first and second zone heating devices, said first and second zone heating devices and forming roller being spaced from each other, and said forming roller being located between said first and second heating devices; and a movable guide means for engaging the edge of said metal plate and maintaining said first burners at a second preselected transverse distance relative to the edge of the metal plate.

29. An apparatus, as set forth in claim 28, including third actuator means for moving the movable guide means transversely relative to the first and second sides of the metal plate between a first position at which the movable guide means is aligned to engage the plate edge and a second position spaced from the first position at which the movable guide means is spaced from being aligned to engage the plate edge.

30. An apparatus, as set forth in claim 28, wherein said fixed guide means includes a first pair of spaced rollers rotatively connected to the supporting frame of the first and second zone heating devices, and the movable guide means includes a second pair of spaced rollers rotatively connected to the supporting frame of the first and second zone heating devices, said first and second roller pairs being engagable with the plate edge.

31. An apparatus for selectively forming a thickened edge along an edge of a metal plate having first and second sides, comprising:

a metal plate forming roller having a longitudinal axis of rotation and being forcibly engagable with an edge of a metal plate, said longitudinal forming roller axis being oriented transversely relative to the first and second sides of the metal plate;

power means for reciprocally moving one of the metal plate and the forming roller transverse the forming roller axis, said forming roller upsetting at least a portion of the edge along the metal plate into a thickened edge during said relative reciprocating movement;

a first zone heating device having a supporting frame and first and second burners movably connected to the supporting frame, said first burner being movable relative to the supporting frame between a first position at which said first burner is spaced a preselected first transverse distance from the first side of the metal plate and a second position at which the first burner is spaced a second preselected transverse distance from the first side of the metal plate, said second burner being movable between a first position spaced a preselected first transverse distance from the second side of the metal plate and a second position spaced a second preselected distance from the second side of the metal plate;

a second zone heating device having a supporting frame and first and second burners, said first burner of the second zone heating device being movable relative to the supporting frame of the second zone heating device between a first position at which said first burner of the second zone heating device is spaced a first preselected transverse distance from the first side of the metal plate and a second position at which the first burner of the second zone heating device is spaced a second preselected transverse distance from the first side of the metal plate, said second burner of the second zone heating device being movable relative to the supporting frame of the second zone heating device between a first position at which the second burner of the second zone heating device is spaced a first preselected transverse distance from the second side of the metal plate and a second position at which the second zone heating device is spaced a second preselected transverse distance from the second side of the metal plate;

first actuator means for moving the first burner of each of the first and second heating devices between said first and second spaced positions;

second actuator means for moving each of the second burners between said first and second positions relative to the second plate side;

drive means for moving said first and second heating devices transversely relative to said plate edge;

fixed guide means for engaging the edge of said metal plate and maintaining the first burner of the first and second zone heating devices at a predetermined first transverse distance spaced from the edge of the metal plate, said fixed guide means being connected to the supporting frame of the first and second zone heating devices, said first and second zone heating devices and forming roller being spaced from each other, and said forming roller being located between said first and second heating devices, said supporting frames of the first and second zone heating devices each being pivotally connected to a respective carriage assembly and each being pivotal about a respective axis extending transverse the sides of said metal plate, said carriage assemblies each being supported on and movable along a trackway, said first and second zone heating devices each being pivotal about said respective axis in response to transverse movement of the metal plate relative to the forming roller and subsequent to engagement between the plate edge and the fixed guide means.

32. An apparatus, as set forth in claim 28, wherein said drive means including:

a first linear actuator having a movable member connected to the carriage of the first zone heating device, said first zone heating device being movable toward said plate edge in response to movement of the movable member;

a second linear actuator having a movable member connected to the carriage of the second zone heating device, said second zone heating device being movable toward said plate edge in response to movement of the movable member of the second actuator.

33. An apparatus, as set forth in claim 32, wherein said drive means includes first and second flexible members trained over a plurality of sheaves and connected to the carriage of the first and second heating devices, respectively, and the movable members of the first and second linear actuators respectively.

34. An apparatus, as set forth in claim 31, wherein the fixed guide means includes a first pair of spaced rollers rotatively connected to the supporting frame of the first and second zone heating devices, said first roller pair being selectively engagable with the plate edge.

35. An apparatus for selectively forming a thickened edge along an edge of a metal plate having first and second sides, comprising:

a metal plate forming roller having a longitudinal axis of rotation and being forcibly engagable with an edge of a metal plate, said longitudinal forming roller axis being oriented transversely relative to the first and second sides of the metal plate;

power means for reciprocally moving one of the metal plate and the forming roller transverse the forming roller axis, said forming roller upsetting at least a portion of the edge along the metal plate into a thickened edge during said relative reciprocating movement;

a zone heating device having a supporting frame and a first burner movably connected to the supporting frame, said supporting frame having a pivot axis oriented transverse the plate first side and being pivotally movable about the pivot axis, said first burner being movable between first and second spaced positions relative to the first side of the metal plate;

actuator means for moving the first burner between said first and second spaced positions;

drive means for receiving a drive signal and moving said zone heating device transversely relative to said plate edge in response to receiving said drive signal;

fixed guide means for engaging the edge of said plate and maintaining the first burner at a predetermined first transverse location spaced from the edge of the plate, said fixed guide means being connected to the supporting frame.

36. An apparatus, as set forth in claim 35, including:

means for sensing a position of the first burner relative to the first side of the metal plate and delivering a position signal in response to the first burner being at the second position; and control means for receiving said position signal and enabling the delivery of said drive signal, said drive means moving said zone heating device only at the second position of said first burner.

37. An apparatus for zone heating a metal plate having first and second spaced sides during the forming of a thickened edge along an edge of a metal plate; comprising:

first and second zone heating devices each having first and second spaced movable burners, said first burners being located on the first side of said plate and said second burners being located on the second side of said plate, said first burners being movable between first and second predetermined spaced heating positions transversely relative to the plate first side and said second burners being movable between said first and second predetermined spaced heating positions transversely relative to the plate second side;

fixed guide means for maintaining the first and second burners of the first and second heating devices at a first predetermined transverse location relative to the plate edge, said fixed guide means being connected to the first and second heating devices and being engagable with the plate edge at the first transverse location relative to the plate edge, said guide means being connected to the first and second heating devices;

actuating means for moving said first and second burners between said first and second spaced positions relative to the plate sides;

drive means for moving the first and second heating devices transversely relative to the plate edge;

means for sensing said fixed guide means being at the first transverse location and responsively delivering a guide position signal;

control means for receiving said guide position signal and delivering a control signal in response to receiving said guide position signal, said drive means receiving said control signal and stopping transverse movement of at least one of the first and second heating devices relative to the plate edge in response to receiving said control signal; and said control means including a processor having a memory and preprogrammed instructions stored in said memory, said processor executing said instructions and commanding movement of said burners and said fixed guides transversely relative to the plate sides, and movement of said heating devices transversely relative to the plate edge.

38. An apparatus for zone heating a metal plate having first and second spaced sides during the forming of a thickened edge along an edge of a metal plate; comprising:

first and second spaced zone heating devices each having first and second spaced movable burners, said first burners being located on the first side of said plate and said second burners being located on the second side of said plate, said first burners being movable between first and second predetermined spaced heating positions transversely relative to the plate first side and said second burners being movable between said first and second predetermined spaced heating positions transversely relative to the plate second side;

fixed guide means for maintaining the first and second burners of the first and second heating devices at a first predetermined transverse location relative to the plate edge, said fixed guide means being connected to the first and second heating devices and being engagable with the plate edge at the first transverse location relative to the plate edge, said guide means being connected to the first and second heating devices;

actuating means for moving said first and second burners between said first and second spaced positions relative to the plate sides;

drive means for moving the first and second heating devices transversely relative to the plate edge;

means for sensing said fixed guide means being at the first transverse location and responsively delivering a guide position signal;

control means for receiving said guide position signal and delivering a control signal in response to receiving said guide position signal, said drive means receiving said control signal and stopping transverse movement of at least one of the first and second heating devices relative to the plate edge in response to receiving said control signal, said control means delivering a signal to said actuating means and said actuating means moving said first and second burners from said first position to said second position prior to said control means delivering a signal to said drive means, said drive means moving said first and second heating devices to a location at which said fixed guide means is spaced from said plate edge and said first and second heating devices are transversely spaced from the plate edge.

* * * * *